US008458834B1

(12) United States Patent
Brown

(10) Patent No.: US 8,458,834 B1
(45) Date of Patent: Jun. 11, 2013

(54) TRAVEL PILLOW

(71) Applicant: Bobby Glenn Brown, Dallas, TX (US)

(72) Inventor: Bobby Glenn Brown, Dallas, TX (US)

( * ) Notice: Subject to any disclaimer, the term of this patent is extended or adjusted under 35 U.S.C. 154(b) by 0 days.

(21) Appl. No.: 13/629,250

(22) Filed: Sep. 27, 2012

(51) Int. Cl.
*A47C 7/38* (2006.01)

(52) U.S. Cl.
USPC ..... 5/644

(58) Field of Classification Search
USPC ..... 5/636, 630, 644, 639; 297/397, 219.1, 297/220
See application file for complete search history.

(56) References Cited

U.S. PATENT DOCUMENTS 5,412,822 A * 5/1995 Kelly ..... 5/655.3
5,544,378 A * 8/1996 Chow ..... 5/644

* cited by examiner

*Primary Examiner* — Frederick Conley
(74) *Attorney, Agent, or Firm* — Kenneth L Tolar

(57) ABSTRACT

A travel pillow includes a base panel having a plurality of segregated, independently-inflatable bladders therein for supporting a user's head and neck. Extending from each of two opposing side edges of the base panel is a fastening strap having a hook-and-loop fastener thereon. Accordingly, the fastening straps are secured about a passenger seat headrest or other support surface to provide a pillow for supporting a passenger's head that can be inflated to a desired firmness.

10 Claims, 2 Drawing Sheets

TRAVEL PILLOW

CROSS REFERENCE TO RELATED APPLICATIONS

This application is a continuation-in-part of application Ser. No. 12/855,940, filed on Aug. 13, 2010, now abandoned, and is entitled to the benefit of provisional application No. 61/238,839 filed on Sep. 1, 2009, the specifications of which are incorporated herein by reference.

BACKGROUND OF THE INVENTION

The present invention relates to a travel pillow for vehicle passengers.

DESCRIPTION OF THE PRIOR ART

Sleeping on an airplane, bus, train or other vehicles has always been difficult and challenging. Though most public transportation services provide a small pillow for supporting a passenger's head, the pillow easily shifts, placing the head in awkward and uncomfortable positions. Accordingly, there is currently a need for a travel pillow that overcomes the above-described disadvantages associated with sleeping in vehicle seats. The present invention addresses this need by providing a pillow having a plurality of bladders, each of which can be independently inflated to a desired firmness to support a traveler's head or neck.

SUMMARY OF THE INVENTION

The present invention relates to a travel pillow comprising a base panel having a plurality of segregated, independently-inflatable bladders therein for supporting a user's head and neck. Extending from each of two opposing side edges of the base panel is a fastening strap having a hook-and-loop fastener thereon. Accordingly, the fastening straps are secured about a passenger seat headrest or other support surface to provide a pillow for supporting a passenger's head that can be inflated to a desired firmness.

It is therefore an object of the present invention to provide a travel pillow that assists a traveler with sleeping in a vehicle.

It is another object of the present invention to provide a travel pillow that is securable to a passenger seat headrest to prevent shifting during use.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
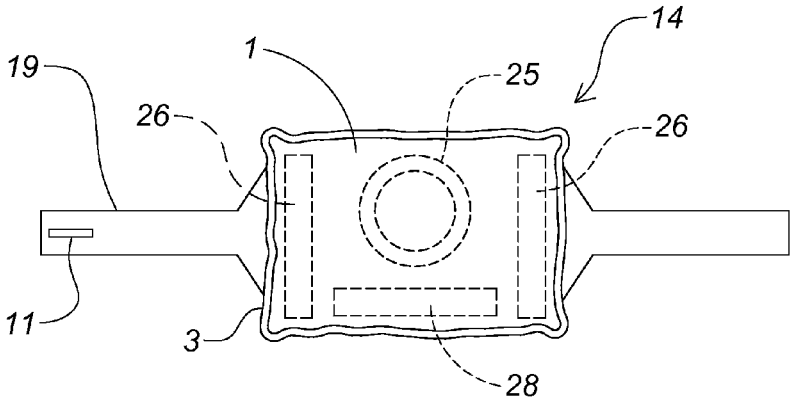
FIG. 1 is a front, plan view of the travel pillow.
Figure 2:
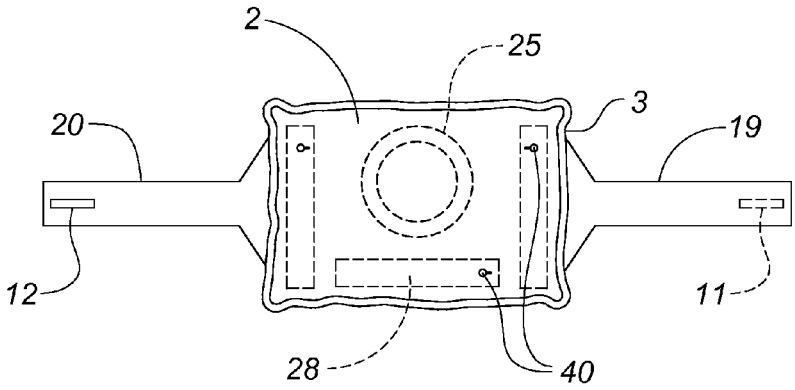
FIG. 2 is a rear, plan view of the travel pillow.
Figure 3:
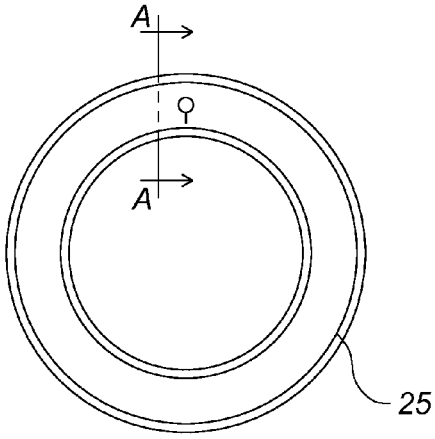
FIG. 3 is an isolated view of the inflatable upper bladder.
Figure 4:
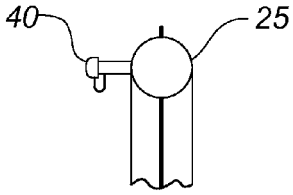
FIG. 4 is a cross-sectional view of the upper bladder taken along A-A in FIG. 3.
Figure 6:
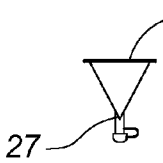
FIG. 6 is a lateral view of the side bladder depicted in FIG. 5.
Figure 9:
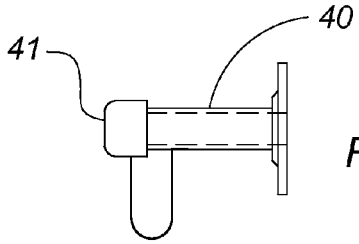
FIG. 9 is an isolated view of an exemplary refill valve for the inflatable bladders.
Figure 5:
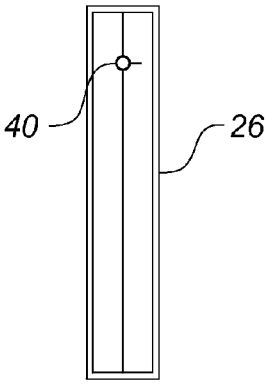
FIG. 5 is an isolated view of an exemplary side bladder.
Figure 7:
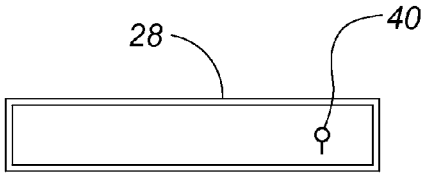
FIG. 7 is an isolated view of the horizontal, tubular bladder.
Figure 8:
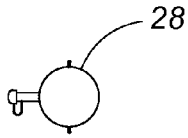
FIG. 8 an end view of the bladder depicted in FIG. 7.

The present invention relates to a travel pillow comprising a base panel 14 having a front surface 1, a rear surface 2 and a pair of opposing side edges 3. Extending from each side edge of the base panel is a fastening strap for encompassing a passenger-seat headrest or other support surface. A first strap 19 has a hook-and-loop fastener 11 on a front surface for releasably engaging a mating fastener 12 on the rear surface of the other strap 20. A logo 7 or other design element may be imprinted on the front surface of the base panel.

Within the base panel are a plurality of pockets, each having an inflatable bladder received therein. An upper bladder 25 is annular with a cylindrical cross section for cradling a user's head when resting on the base panel. A pair of vertically-oriented side bladders 26 are triangular with an apex 27 engaging the rear surface of the panel and a vertical side edge 30 engaging the front surface of the panel. Accordingly, as the side panels are inflated, a projecting barrier forms adjacent each side of the user's head to prevent the head from nodding laterally. Proximal a lower edge of the base panel is a horizontal, tubular bladder 28 that, when inflated, supports the user's neck.

Each bladder includes a designated refill valve 40 with a protective cap 41 extending from the rear surface of the base panel. Therefore, a user can inflate each bladder to a desired firmness by blowing air into the one of the designated refill valves.

Figure 10:
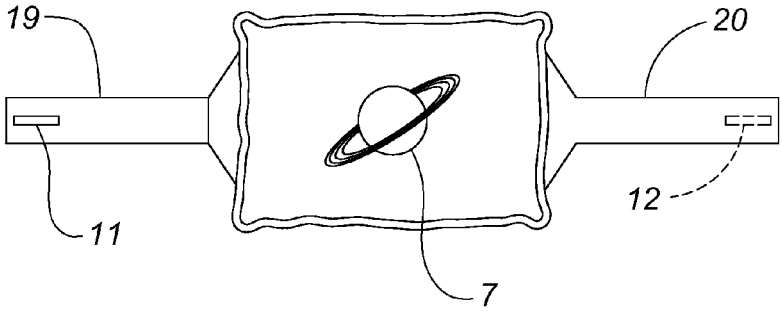
FIG. 10 is a top, plan view of the travel pillow according to a second embodiment of the present invention.
Figure 11:
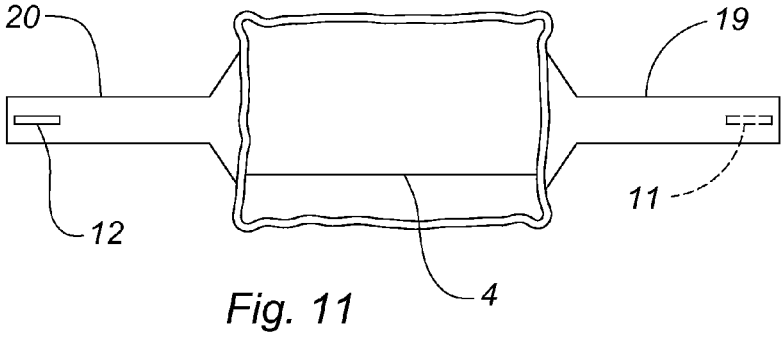
FIG. 11 is a bottom, plan view of the travel pillow of FIG. 10.

A second embodiment of the present invention is depicted in FIGS. 10 and 11, wherein the base panel is hollow with a separable seam 4 on the rear surface. The seam is in communication with an interior compartment to allow a small, travel-type pillow cushion to be inserted therein.

Accordingly, the fastening straps are secured about a passenger-seat headrest or other support surface to anchor the base panel in a desired position. Alternatively, the straps may be secured over a user's eyes or ears to provide a sound or light barrier. Any or all of the bladders may be inflated to a desired firmness to support the user's head in a desired orientation. Furthermore, when the pillow is no longer needed, the bladders may be quickly deflated to easily store the pillow in a travel bag or another convenient location.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A travel pillow comprising:

a base panel having a front surface, a rear surface, a pair of opposing side edges, a lower edge and an upper edge, said base panel including a plurality of independently-inflatable bladders positioned therein for supporting a user's head and neck, one of said bladders being annular and positioned near the upper edge of said base panel for supporting a user's head;

means for securing said base panel to a support surface.

2. The travel pillow according to claim 1 wherein said means for securing said base panel to a support surface comprises:

a first fastening strap extending from one of the side edges of said base panel;

a second fastening strap extending from another of the side edges of said base panel;

means for attaching said first fastening strap to said second fastening strap.

3. The travel pillow according to claim 2 wherein a second bladder is positioned near one of the side edges of said base panel to prevent a user's head from nodding laterally.

4. The travel pillow according to claim 3 wherein said second bladder is triangular having an apex engaging the rear surface of the base panel and a side edge engaging the front surface of the base panel to form a projecting barrier adjacent a user's head when said second bladder is inflated.

5. The travel pillow according to claim 4 wherein a third bladder is tubular, horizontal and positioned near the lower edge of said base panel for supporting a user's neck.

6. The travel pillow according to claim 5 wherein each of said bladders includes a designated refill valve with a protective cap removably positioned thereon, said valve extending from the rear surface of the base panel to allow a user to inflate each bladder to a desired firmness.

7. A travel pillow comprising:

a base panel having a front surface, a rear surface, a pair of opposing side edges, a lower edge and an upper edge;

a first, annular inflatable bladder positioned near the upper edge of said base panel for supporting a user's head;

a second inflatable bladder positioned near one of the side edges of said base panel to prevent a user's head from nodding laterally;

a third inflatable bladder positioned near another of the side edges of said base panel to prevent a user's head from nodding laterally;

a fourth, tubular inflatable bladder positioned near the lower edge of said base panel for supporting a user's neck;

means for securing said base panel to a support surface.

8. The travel pillow according to claim 7 wherein said first annular bladder has a cylindrical cross section.

9. The travel pillow according to claim 7 wherein said second inflatable bladder and said third inflatable bladder are each vertically-oriented and triangular having an apex engaging the rear surface of the base panel and a vertical side edge engaging the front surface of the base panel to form a projecting barrier adjacent each side of a user's head when inflated.

10. The travel pillow according to claim 9 wherein said fourth inflatable bladder is horizontal.

* * * * *